US011834936B2

(12) United States Patent
Wroblicky

(10) Patent No.: US 11,834,936 B2
(45) Date of Patent: Dec. 5, 2023

(54) DISSOLVABLE TIME DELAY FIRING HEAD AND METHOD

(71) Applicant: GEODYNAMICS, INC., Millsap, TX (US)

(72) Inventor: Michael D. Wroblicky, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 87 days.

(21) Appl. No.: 17/347,665

(22) Filed: Jun. 15, 2021

(65) Prior Publication Data

US 2021/0388698 A1 Dec. 16, 2021

Related U.S. Application Data

(60) Provisional application No. 63/039,172, filed on Jun. 15, 2020.

(51) Int. Cl.
*E21B 43/1185* (2006.01)
*F42C 9/08* (2006.01)
*E21B 43/117* (2006.01)

(52) U.S. Cl.
CPC ..... *E21B 43/11852* (2013.01); *F42C 9/08* (2013.01); *E21B 43/117* (2013.01); *E21B 2200/08* (2020.05)

(58) Field of Classification Search
CPC ..... E21B 43/11852; E21B 2200/08; E21B 43/117; F42C 9/08; F42C 15/38
See application file for complete search history.

(56) References Cited

U.S. PATENT DOCUMENTS 2,749,990 A * 6/1956 Carpenter ..... E21B 43/263 102/314
2,912,931 A * 11/1959 Carpenter ..... E21B 43/122 102/275.9
3,010,515 A * 11/1961 Harrison ..... E21B 29/02 166/54.5
5,052,489 A * 10/1991 Carisella ..... F42D 1/04 337/145
5,115,865 A * 5/1992 Carisella ..... E21B 43/1185 337/145
5,511,482 A * 4/1996 DiPietropolo ..... F42B 12/72 102/293
10,208,570 B2 * 2/2019 Hardesty ..... E21B 43/11852
11,702,903 B2 * 7/2023 Sequera ..... E21B 41/00 166/376

(Continued)

*Primary Examiner* — Jonathan C Weber
(74) *Attorney, Agent, or Firm* — Morgan, Lewis & Bockius LLP

(57) ABSTRACT

A firing head configured to initiate the firing of an element in a perforating gun. The firing head includes an insert having a bore extending along a longitudinal direction X; a percussion detonator facing the bore and including an explosive material that is configured to detonate; a firing pin located partially in the bore; and a retention mechanism located on the firing pin and preventing the firing pin to move along the longitudinal direction X into the bore. The retention mechanism includes a degradable material that is configured to chemically react with a well fluid so that the retention mechanism degrades until freeing the firing pin so that the firing pin moves along the longitudinal direction X into the bore and strikes the percussion detonator.

9 Claims, 6 Drawing Sheets

(56) References Cited

U.S. PATENT DOCUMENTS

2008/0066923 A1* 3/2008 Xu ..... E21B 23/00
166/376
2017/0247988 A1* 8/2017 Hardesty ..... E21B 43/11852

* cited by examiner

DISSOLVABLE TIME DELAY FIRING HEAD AND METHOD

BACKGROUND

Technical Field

Embodiments of the subject matter disclosed herein generally relate to a dissolvable perforating gun that is lowered into a casing of a well to perforate the casing, and more specifically, to a dissolvable firing head and method for actuating the dissolvable perforating gun based on a wellbore pressure existing or being generated in the well.

Discussion of the Background

In the oil and gas field, after a well is drilled and the casing protecting the wellbore has been installed and cemented in place, the wellbore needs to be connected to the subterranean formation to extract the oil and/or gas. This process of connecting the wellbore to the subterranean formation may include a step of fluidly insulating with a plug a previously fractured stage of the well, a step of perforating a portion of the casing, which corresponds to a new stage, with a perforating gun such that plural channels are formed to connect the subterranean formation to the inside of the casing, a step of removing the perforating gun, and a step of fracturing the plural channels of the new stage by pumping a fluid into the channels. These steps are repeated until all the stages of the well are fractured.

The perforating guns are deployed into the well in groups, i.e., as a perforating gun string that includes plural perforating guns. Each perforating gun may include any number of shaped charges. The shaped charges are the elements that are detonated inside the well for perforating the casing of the well.

The individual perforating guns encapsulate the corresponding shaped charges with a thick and resistant steel housing to prevent the well fluid contacting the shaped charges or the detonation cord or the detonator or any internal component. When the shaped charges are fired, then need to make perforations not only in the casing of the well, but also in the housing of the perforating gun. Thus, after the perforation stage has been completed, the operator of the well needs to use various tools to remove the debris left behind, i.e., the perforated housing, and whatever is left of the shaped charges and the other components of the perforating gun. This operation typically involves either removing the perforating gun with a wireline or a slickline or drilling the perforating gun to break it into smaller parts and then flushing it to the surface to clean out the bore of the casing if the perforating guns are stuck in the well. All these operations are costly, time consuming and not guaranteed to succeed.

To reduce cost and time associated with the operation of removing the spent perforating guns, newer perforating guns are using various dissolvable materials for making the parts of the perforating gun. These materials, when chemically interacting with the well fluid, start to dissolve. This happens when the perforating gun is lowered into the well or after the perforating gun is fired, if the casing is made of a non-dissolvable material, as the housing of the gun seals its interior before the shaped charges perforate the housing. However, after firing the shaped charges, the well fluid is free to enter inside the housing of the gun and interact with what is left from the shaped charges, detonator, switch, and any other auxiliary elements. Thus, if all the internal elements are made or at least include some of the dissolvable material, the well fluid would dissolve these materials and reduce the time and cost necessary for taking out the remaining elements of the perforating guns, especially for autonomous perforating guns.

While many parts of the existing perforating guns have been modified to include such dissolvable materials, some other parts cannot be modified, for example, the electronics associated with the switch for initiating the detonator. Thus, there are presently limitations for what parts of the traditional perforating gun can be made to be dissolvable.

The fact that the partially dissolvable perforating guns use the traditional electronics creates additional problems as there are standards in the industry that govern the use of the explosive materials in such devices and how such devices can be transported from the manufacturer to the operator of the gun. Such standards require at least two independent actions before the shaped charges are activated, which is a challenge for some of the existing perforating guns that use electronics for initiating the perforation phase.

Thus, there is a need to further adapt the perforating guns to make even the mechanism that triggers the shaped charges dissolvable while ensuring that the more stringent standard requirements are fulfilled.

SUMMARY

According to an embodiment, there is a firing head configured to initiate the firing of an element in a perforating gun. The firing head includes an insert having a bore extending along a longitudinal direction X; a percussion detonator facing the bore and including an explosive material that is configured to detonate; a firing pin located partially in the bore; and a retention mechanism located on the firing pin and preventing the firing pin to move along the longitudinal direction X into the bore. The retention mechanism includes a degradable material that is configured to chemically react with a well fluid so that the retention mechanism degrades until freeing the firing pin so that the firing pin moves along the longitudinal direction X into the bore and strikes the percussion detonator.

According to another embodiment, there is a perforating gun system for perforating a casing of a well. The perforating gun system includes a perforating gun that includes shaped charges configured to perforate the casing, and a firing head attached to the perforating gun and configured to directly or indirectly initiate the shaped charges, exclusively due to a pressure difference formed in the well. The firing head includes a degradable material that chemically interacts with a well fluid.

According to still another embodiment, there is a method for assembling a perforating gun to be fired inside a well. The method includes placing a percussion detonator in a firing head to face a bore of an insert, adding a retention mechanism to a firing pin, placing the firing pin partially inside the bore to seal the bore, connecting the firing head to the perforation gun so that the percussion detonator is facing a booster inside the perforation gun, and making holes into a housing of the firing head to allow a well fluid to enter inside the firing head and chemically interact with a degradable material of the retention mechanism to release the firing pin to strike the percussion detonator. The firing pin strikes the percussion detonator due exclusively to a pressure difference inside the well.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a single perforating gun used for perforating a casing in a horizontal well. However, the embodiments discussed herein may be used for plural perforating guns or other tools that are used in a well, and also for tools that are provided inside a vertical well.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, the electronics used for initiating a detonator that fires the shaped charges of a perforating gun is replaced with a firing head and the electric detonator is replaced with a percussion detonator, which is configured to be initiated when impacted by a firing pin of the firing head. The firing pin and the percussion detonator may be placed in the firing head, which ballistically communicates with a detonation cord or similar explosive material in the perforating gun. Because of a dissolvable material used to hold the firing pin still inside the firing head, the firing head is in fact a time delay firing head. The firing pin is actuated exclusively by a pressure difference between the high pressure in the well and the low pressure in the firing head. In one application, no electrical signals are used to initiate the move of the firing pin or to ignite the detonation cord in the perforating gun. The firing pin is held in place with a retention device that is made of the dissolvable material. Only after the well fluid chemically interacts for a certain time with the retention mechanism and partially dissolves it, the firing pin is actuated by the existing well fluid pressure. This ensures that the new firing head is compliant with the explosive materials requirements for the perforating guns, as there are at least two independent actions that need to take place to fire the percussion detonator. The details of these features are now discussed with regard to the figures.

Figure 1:
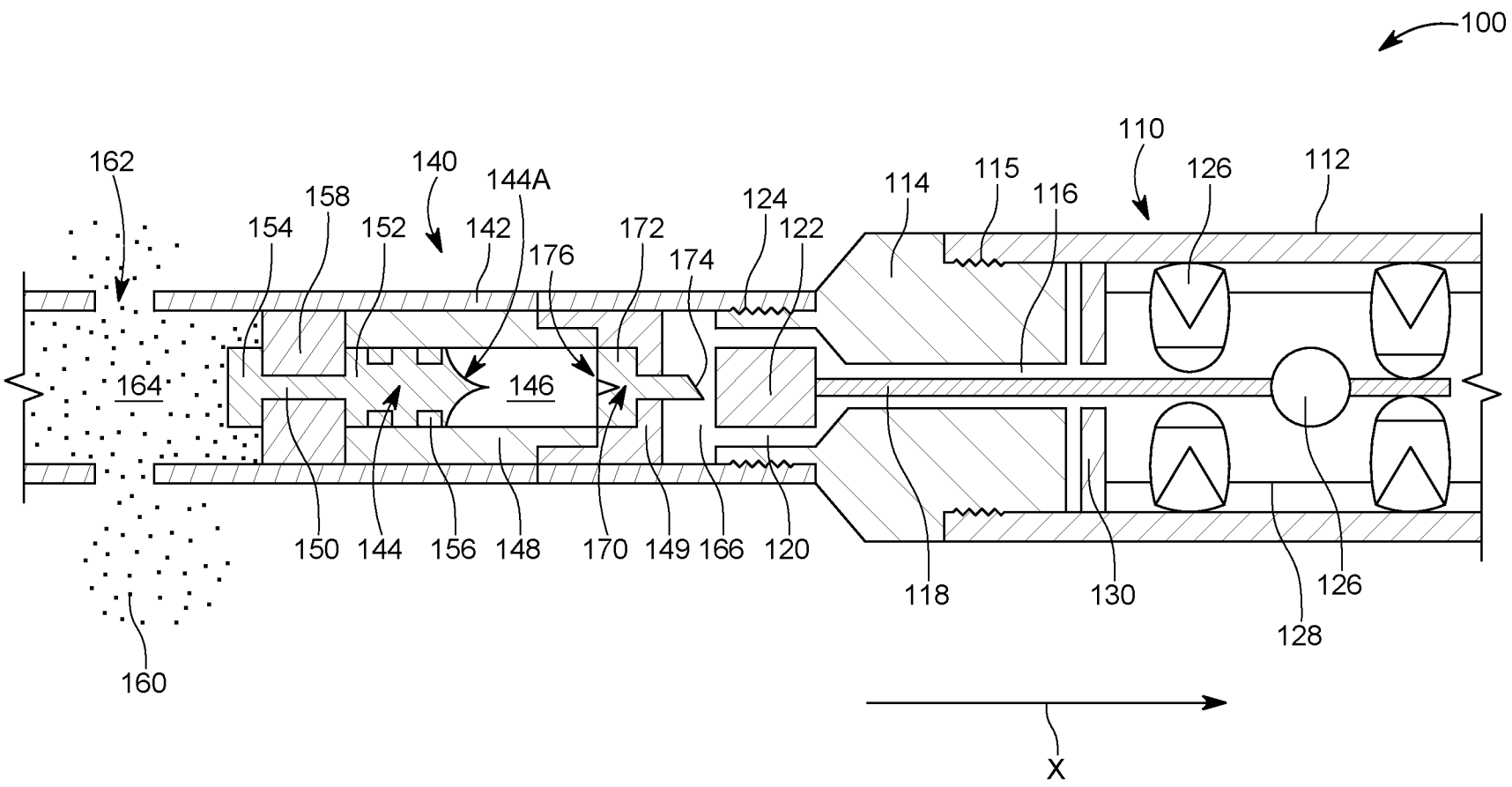
FIG. 1 illustrates a perforating gun system having a firing head attached to a perforating gun and the firing head being configured to actuate the perforating gun based exclusively on a pressure difference in the well.

FIG. 1 shows an embodiment in which a perforating gun system 100 includes at least one perforating gun 110 and a corresponding firing head 140. The perforating gun 110 may include a housing 112 that is attached, for example, with threads 115, to a firing adaptor 114. The firing adaptor 114 has a bore 116 configured to hold the detonation cord 118. The body of the firing adaptor 114 forms an open cavity 120, that faces the firing head 140 and holds a booster 122, which transfers and boosts the ballistic fire from the firing head 140, to the detonation cord 118. The firing adaptor 114 has threads 124 to connect to a housing 142 of the firing head 140. In one application, the firing adaptor is part of the perforating gun 110.

The housing 112 of the perforating gun 110 is configured to hold the detonation cord 118 and also the shaped charges 126. In fact, a loading tube 128 has corresponding holes that hold the shaped charges 126 and the loading tube with the shaped charges are slid into the housing 112. The loading tube 128 is closed with an end cap 130, which is also used to centralize the loading tube 128 relative to the housing 112. The elements of the perforating gun 110 may be made, partially or totally, based on one or more dissolvable materials.

The housing 142 of the firing head 140 is configured with threads at each end to engage the corresponding perforating gun and an additional tool, e.g., a sub, another perforating gun, a setting tool, a wireline or a slickline (not shown). Inside the housing 142 there is a firing pin 144 that is held in the bore 146 of an insert 148. The insert 148 may be part of the housing 142 or may be a separate piece of material that tightly fits into the housing 142. The firing pin 144 has a neck region 150 that connects a main body 152 to a head portion 154. The main body 152 is sized to fit tightly inside the bore 146 of the insert 148 and also to be able to move along the longitudinal axis X of the bore 146. The main body 152 is provided with one or more o-rings 156 for ensuring that an interface between the body 152 and the insert 148 is water tight, so that the well fluid cannot enter into the bore 146. In this regard, note that the bore 146 of the insert 148 is closed by a percussion detonator 170 at the other end. Also note that the body 152 of the firing pin 144 is located inside the bore of the insert 148 while the head portion 154 is located outside the bore of the insert in this embodiment.

The neck region 150 of the firing pin 144 has a smaller diameter than the head portion 154 and the main body 152 so that a retention mechanism 158 can be formed around the neck region 150 and the retention mechanism 158 is held in place between the head portion and the main body, i.e., the retention mechanism cannot slide up or down relative to the neck region 150. This ensures that the retention mechanism 158 is hold in place by the insert 148 of the firing head and cannot slid along the X direction, which also means that the firing pin 144 cannot slid along the X direction unless the retention mechanism is removed. In this embodiment, the retention mechanism is implemented as a washer. However, the retention mechanism may be implemented in other ways. The retention mechanism 158 is made in this embodiment from a dissolvable material so that when in contact with the well fluid, the retention mechanism chemically reacts with the well fluid and starts to disintegrate until its structure collapses and releases the firing pin 144.

To promote the direct contact between the retention mechanism 158 and the well fluid 160, one or more holes 162 are formed in the housing 142 so that the well fluid is allowed to freely enter, in this embodiment, inside a chamber 164 defined by (1) the housing 142, (2) the head portion 154 of the firing pin 144, and (3) the retention mechanism 158. In this embodiment, the retention mechanism 158 is implemented as a retention washer. In this way, as soon as the system 100 is lowered into the well, the well fluid 160 can enter inside the chamber 164 and directly contact the retention mechanism 158 to chemically react with it. Depending on the material used for the retention mechanism, it can start degrading in a matter of minutes. In one embodiment, the retention mechanism is designed to lose its structural soundness in about 10 minutes. In another embodiment, the retention mechanism is designed to lose its structural soundness in about 6 hours. Those skilled in the art would understand that any time between 10 minutes and 6 hours can be selected and the retention mechanism may be designed accordingly to lose its structural soundness.

According to an embodiment, the chemical reaction between the degradable material from which the retention mechanism 158 is made and the well fluid 160 may be an exothermic reaction that gives off heat. The energy needed to initiate the chemical reaction may be less than the energy that is subsequently released by the chemical reaction. According to another embodiment, the chemical reaction may be an endothermic reaction that absorbs heat. The energy needed to initiate the chemical reaction may be greater than the energy that is subsequently released by the chemical reaction.

The rate of the chemical reaction may be accelerated or retarded based on factors such as the nature of the reactants, particle size of the reactants, concentration of the reactants, pressure of the reactants, temperature and catalysts. According to an application, a catalyst may be added to alter the rate of the reaction. According to another application, the material of the retention mechanism may be selected from a group including a mixture of aluminum, copper sulfate, potassium chlorate, and calcium sulfate, iron, magnesium, steel, degradable, magnesium-iron alloy, particulate oxide of an alkali or alkaline earth metal and a solid, particulate acid or strongly acid salt, or mixtures thereof. The catalyst may be selected from a group including salts. According to yet another embodiment, the material of the retention mechanism may be selected from a group including a metal, non-metal or alloy.

Figure 2A:
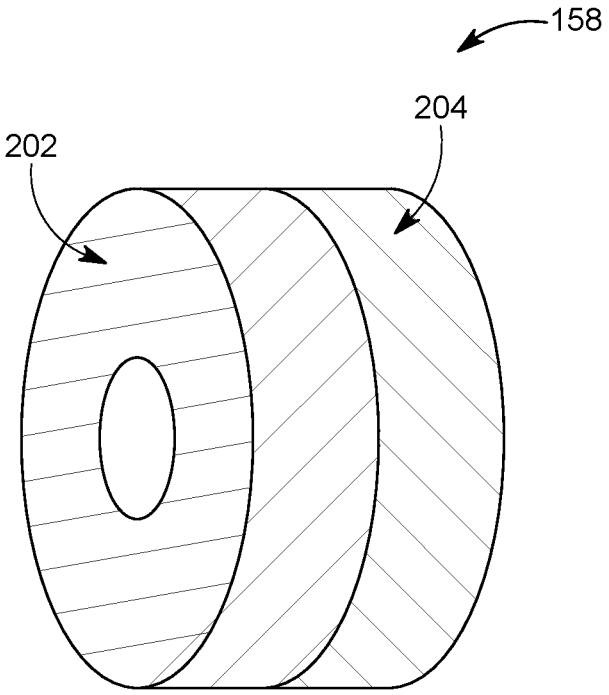
FIGS. 2A and 2B illustrate various configurations of a retention mechanism used to hold a firing pin fixed inside the firing head.
Figure 2B:
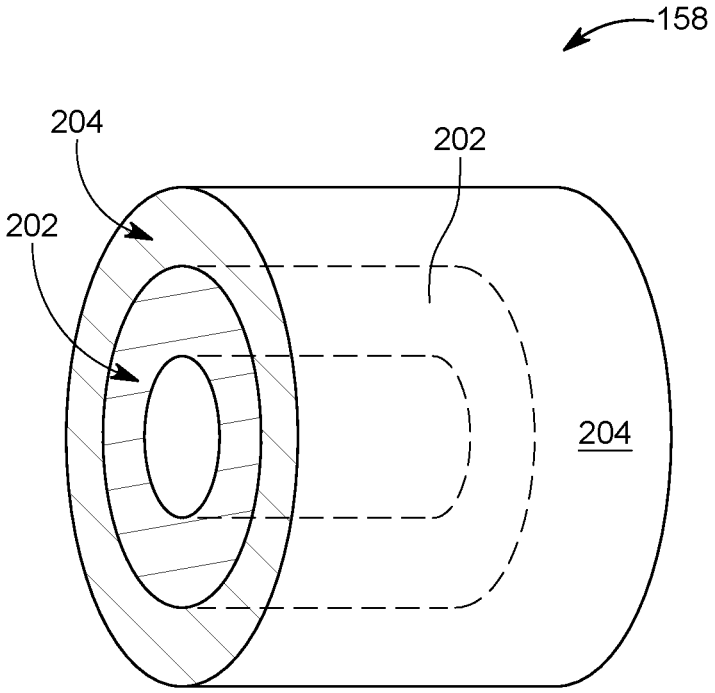

According to an alternate embodiment, a multi-stage retention mechanism may be used, as illustrated in FIGS. 2A and 2B. More specifically, FIG. 2A shows a blocking member 202 that is placed over the degradable material 204 of the retention mechanism 158 to increase the time delay until the soundness of the structure is lost. The blocking member 202 may be made of a material that reacts much slower with the well fluid than the degradable material 204 or does not react at all. In this embodiment, the blocking member 202 completely covers the degradable material 204. In the embodiment of FIG. 2B, the blocking member 202 only partially covers the degradable material 204. In one embodiment, the entire retention mechanism 158 is made of the degradable material 204. The two materials may have different compositions and reaction times with the well fluid. The blocking member may react with the well fluid for a period of time and may restrict fluid access to the retention mechanism for a pre-determined period of time. It should be noted that the multi stage retention mechanisms shown in FIGS. 2A and 2B are not limited to a single blocking member and a single degradable material. Any number of blocking members and degradable materials may be used in combination to achieve a desired time delay. The reaction times and therefore the time delays of each of the members with the well fluid may be characterized at various temperatures expected in the wellbore.

The percussion detonator 170 includes an explosive material 172 that may be held in a casing (not shown). The explosive material is selected so that when a firing pin hits the casing and indirectly the explosive material, it detonates. Thus, a tip 144A of the firing pin 144 is made to be very narrow so that when the tip 144A strikes the percussion detonator 170, the explosive material 172 ignites. The explosive material 172 is placed to be close and directly face the booster 122, so that the ballistic fire power from the percussion detonator 170 directly interacts with the booster 122 and detonates it. In one application, a chamber 166 is present inside the firing head 140 and the chamber 166 fluidly communicates with the open cavity 120, which holds the booster 122. The percussion detonator 170 may be placed in an additional insert 149, which tightly fits inside the housing 142 and is connected to the insert 148, for example, by threads. In one application, the two inserts are welded together. The percussion detonator 170 fits tightly inside the additional insert 149 and abuts against an interior shoulder of the additional insert so that when the firing pin 144 strikes the percussion detonator 170, the percussion detonator cannot move toward the perforating gun 110. The insert 148 and the additional insert 149 are manufactured to share the same bore 146. In one application, the insert 148 and the additional insert 149 may be made as a single part. A tip portion 174 of the percussion detonator 170 extends into the chamber 166 and sits next to the booster 120, as shown in FIG. 1. The chamber 166 is filled with air at atmospheric pressure.

Figure 3:
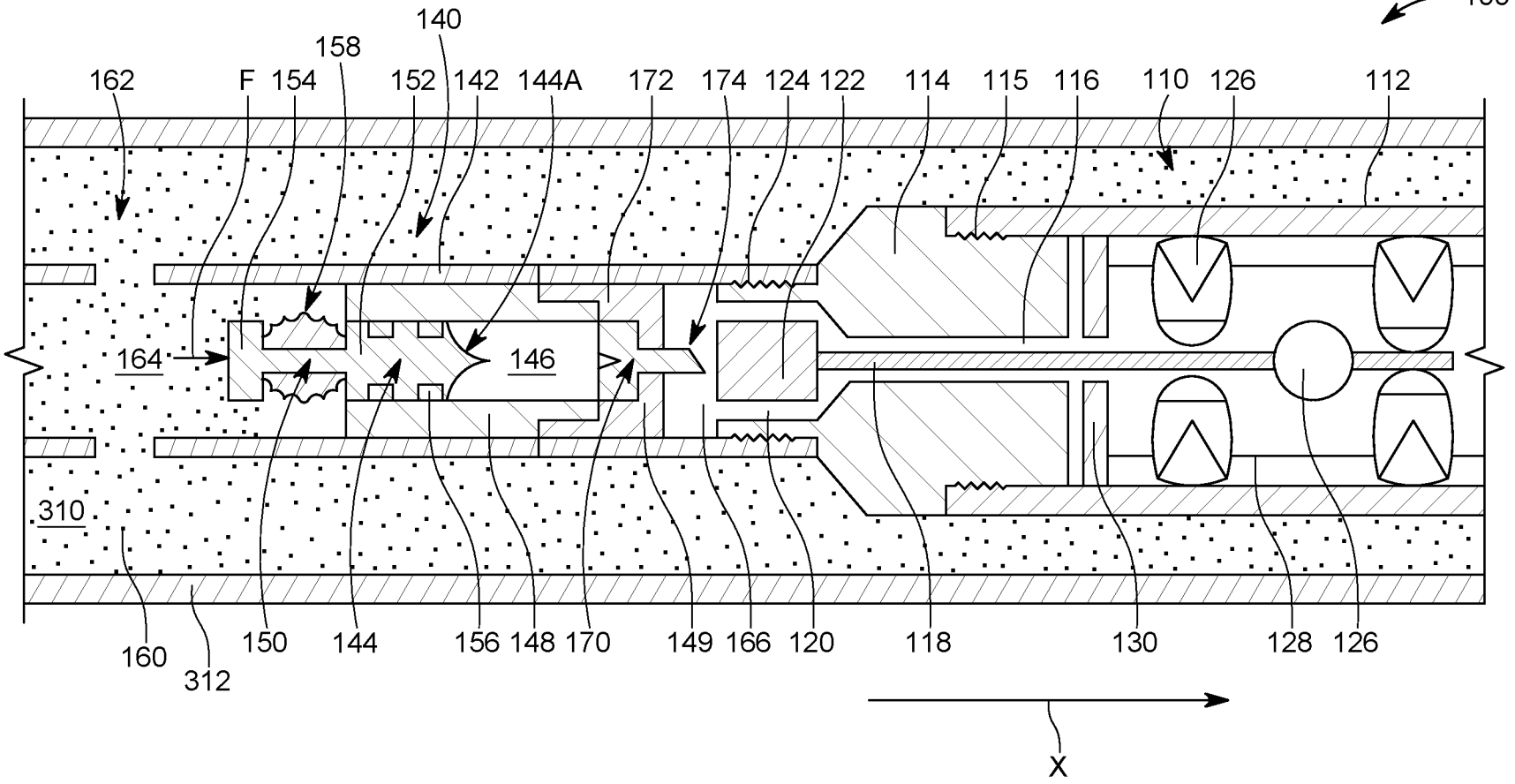
FIG. 3 illustrates how the well fluid from the well chemically interacts with the retention mechanism of the firing head.

FIG. 3 shows the system 100 after being placed in the wellbore 310 of a casing 312 in a well. The well fluid 160 has chemically interacted for a certain amount of time with the retention mechanism 158 and most of the degradable material 204 has been removed. The integrity of the structure of the retention mechanism has been compromised enough that the entire firing pin 144 can now enter into the bore 146 and move along the X direction inside the bore 146. The firing pin 144 moves inside the bore 146 due to the pressure difference between the pressure of the well fluid 160 and the pressure of the air inside the bore 146. The air inside the bore 146 is at atmospheric pressure in this embodiment. As the system 100 is deep inside the well, the pressure difference between the air in the bore 146 and the pressure of the well fluid 160 is large. Due to the surface area of the head portion 154, the force F applied on the firing pin 144, by the pressure difference is large. This force makes the firing pin 144 to move quickly and strike with the tip portion 144A a notch 176 formed in the percussion detonator 170, thus igniting it.

Figure 4:
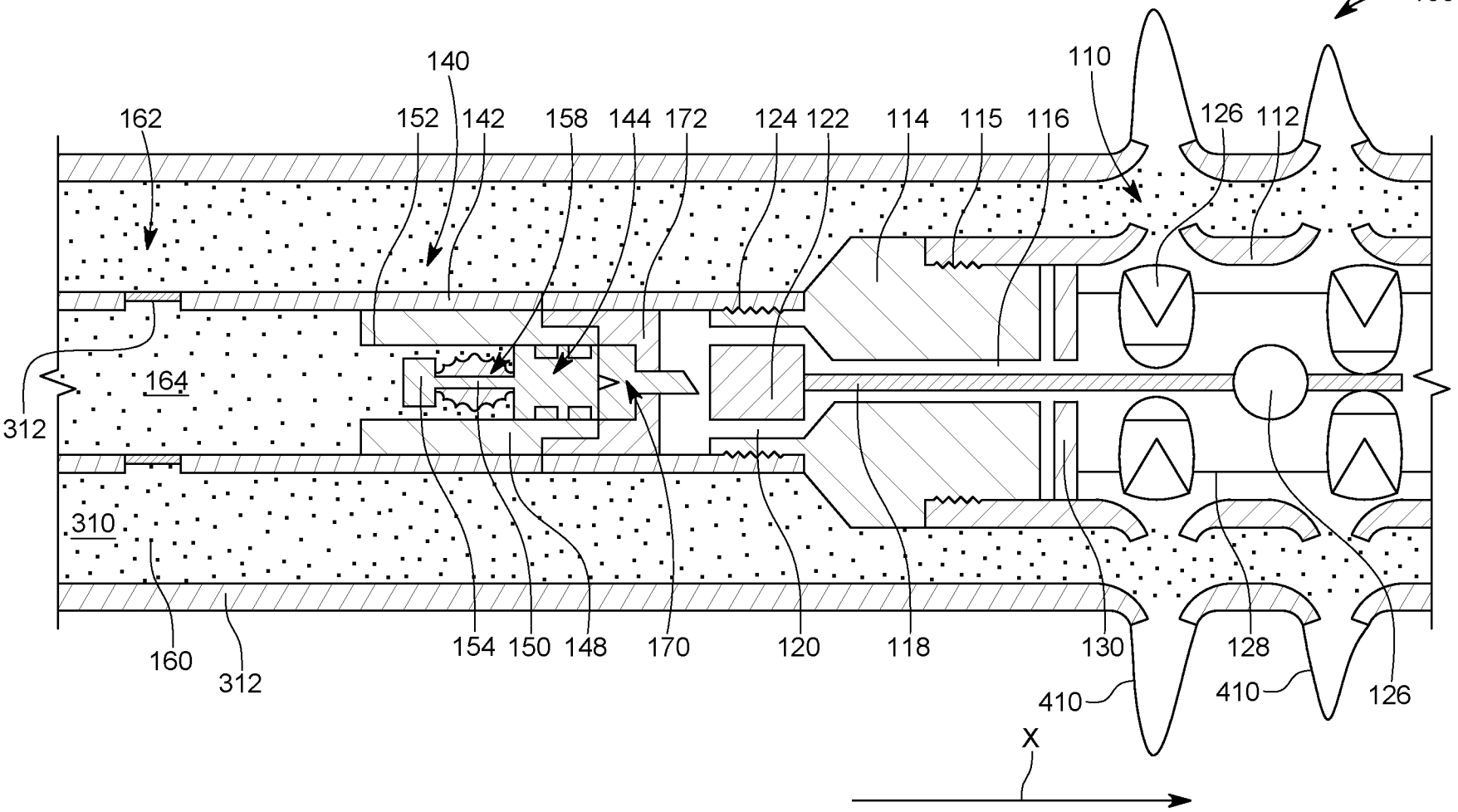
FIG. 4 illustrates the retention mechanism being degraded so much by the well fluid that the firing pin is free to move within the firing head.

The ballistic fire power from the percussion detonator 170 ignites the booster 122, which in turn ignites the detonation cord 118. The fire power moves along the detonation cord 118 until reaching the shaped charges 126, at which time they are actuated and perforate the casing 312 as shown in FIG. 4. FIG. 4 also shows the firing pin 144 moved to the other end of the bore 146 and channels 410 being formed into the formation around the casing 312 due to the shaped charges. Although FIG. 4 shows the percussion detonator 170, booster 122, detonation cord 118, and shaped charges 126 unchanged from FIG. 3, it is understood that all these elements are either broken into small pieces or effectively pulverized by the various explosions that took place inside the perforating gun 110.

Figure 5:
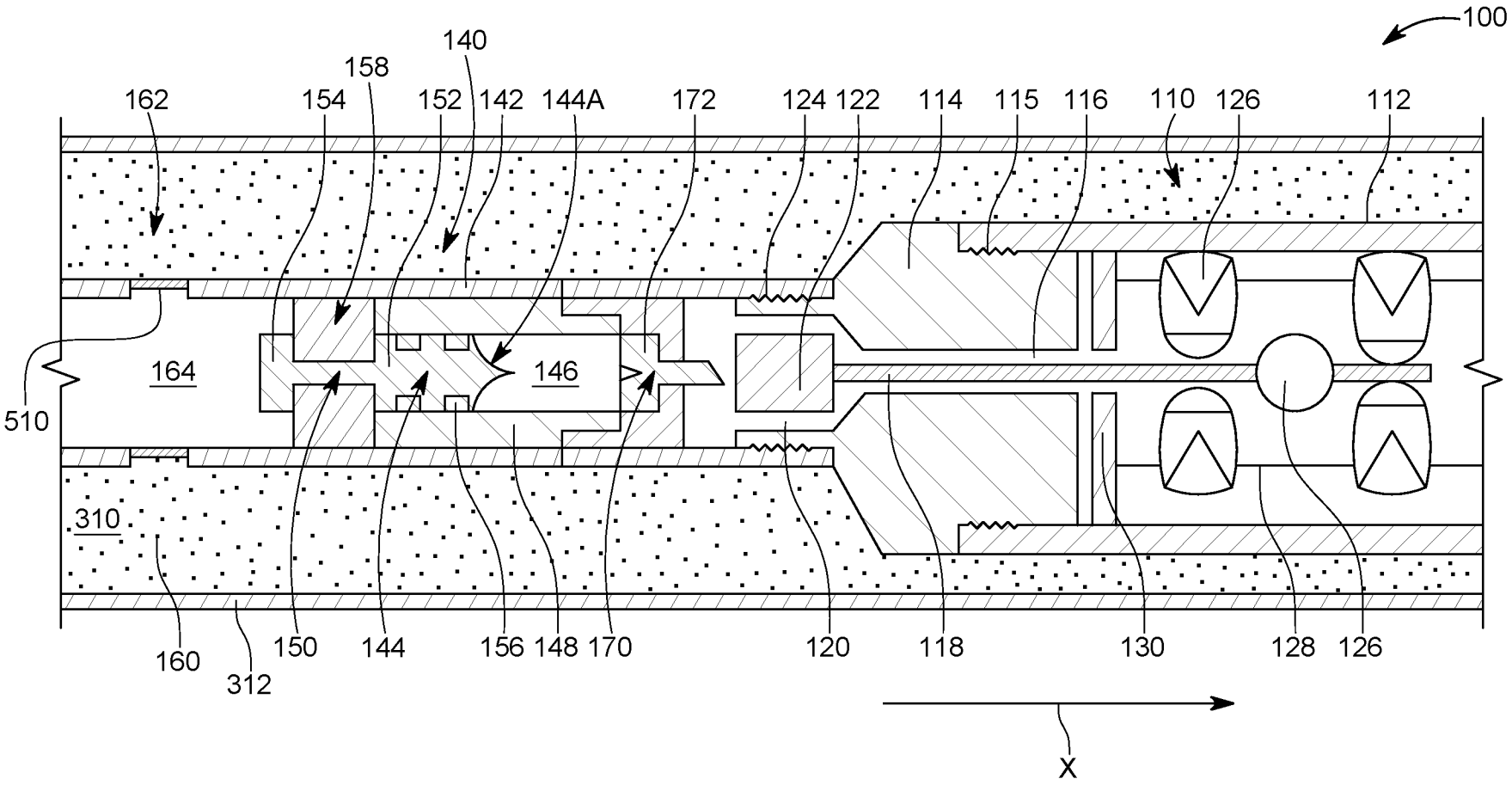
FIG. 5 illustrates a housing of the firing head having one or more holes that are covered by a cap for preventing the well fluid to chemically interact with the retention mechanism.

FIG. 5 shows another embodiment in which the one or more holes 162 formed in the housing 142 of the firing head 140 are blocked by a corresponding cap 510, so that the well fluid 160 is prevented from entering the chamber 164. The cap 510 may be made of a breakable material that is configured to break at a certain pressure. This pressure may be applied with a surface pump to the well fluid 160, when desired to start the degradation of the retention mechanism 158, so that the cap 510 breaks into pieces and the well fluid enters in contact with the washer 158. In another embodiment, the cap 510 may be made of a degradable material that is configured to degrade within a short time, for example, in the order of minutes, after being exposed to the well fluid. Thus, for these embodiments, the degradation of the retention mechanism 158 does not start the moment the system 100 is placed into the well, but only when a certain pressure is applied to the well fluid or after a certain delay time, which is determined by the degradation characteristics of the cap. If multiple perforating guns are connected to each other and it is desired to detonate each perforating gun independent of the other guns, it is possible to choose different caps for each gun so they either break at different pressures or they lose their integrity at different times. If the embodiment shown in FIG. 1 is used, then the characteristics (thickness, material, etc.) of the retention mechanism for each perforating gun may be selected so that the various perforating guns detonate at different times.

Figure 6:
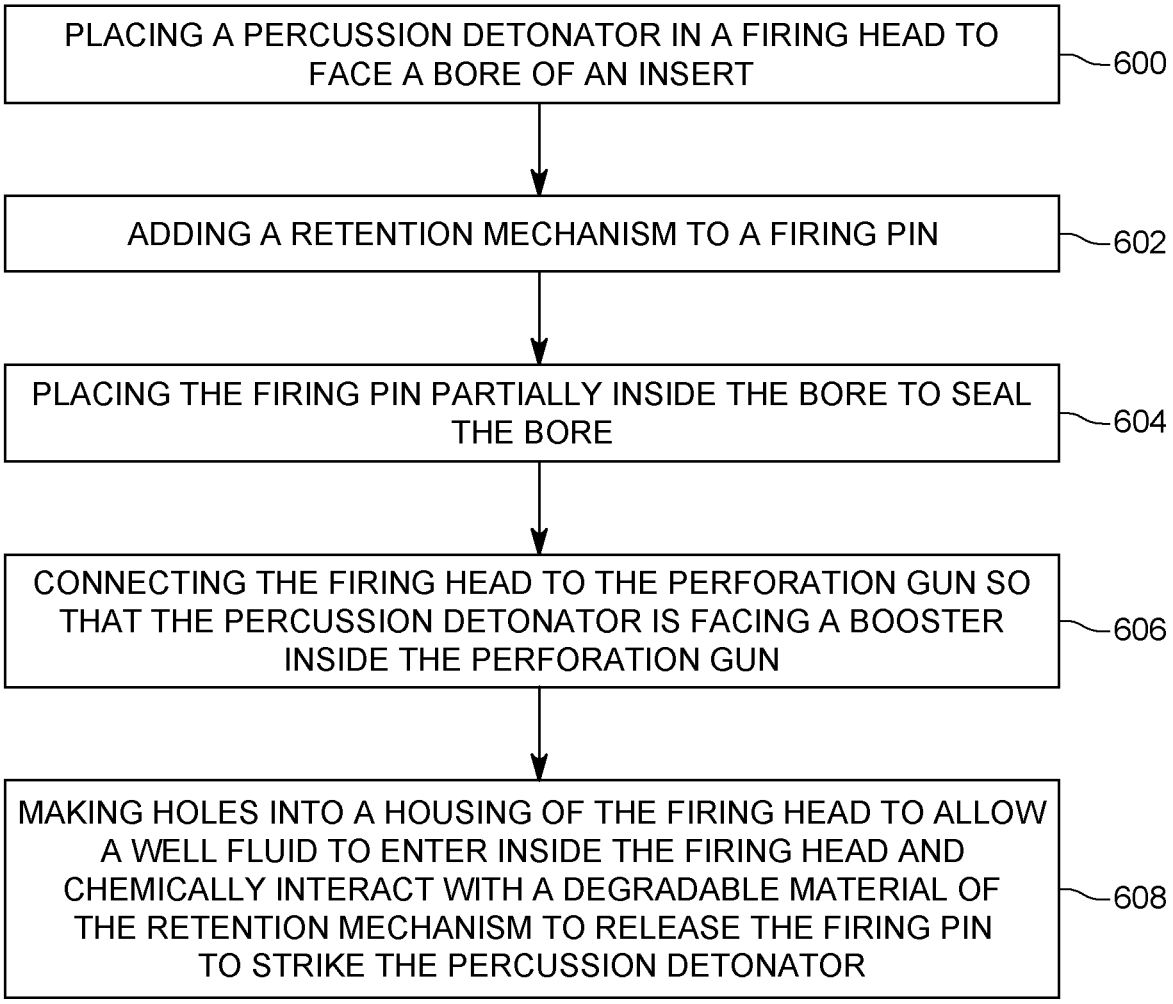
FIG. 6 is a flow chart of a method for assembling the firing head with the perforating gun.

A method for assembling a perforating gun to be fired inside of a well due to the well fluid pressure is now discussed with regard to FIG. 6. The method includes a step 600 of placing a percussion detonator in a firing head to face a bore of an insert, a step 602 of adding a retention mechanism to a firing pin, a step 604 of placing the firing pin partially inside the bore to seal the bore, a step 606 of connecting the firing head to the perforation gun so that the percussion detonator is facing a booster inside the perforation gun, and a step 608 of making holes into a housing of the firing head to allow a well fluid to enter inside the firing head and chemically interact with a degradable material of the retention mechanism to release the firing pin to strike the percussion detonator. The firing pin strikes the percussion detonator due exclusively to a pressure difference inside the well.

The system discussed above allows to initiate the detonation of the shaped charges in a perforating gun without using any electronics attached to the perforating gun. In one embodiment, no electrical cables are used to initiate the shaped charges. The shaped charges' detonation is initiated exclusively based on the pressure of the well fluid. Thus, because no electrical components are used, the retention mechanism can be made of a degradable material, so that the perforating gun 110 and the firing head 140 are both made of degradable materials. In one embodiment, other parts of the firing head 140 may be made of a degradable material. Because the firing of the shaped charges in the embodiments discussed above needs first a chemical interaction between the well fluid and the retention mechanism, and second a pressure high enough in the well fluid to move the firing head with enough force to initiate the percussion detonator, the safety of this configuration complies with the more stringent standard in the industry that requires two safety mechanisms, thus making the present system safer. In addition, because both the perforating gun and the firing head have parts made of dissolvable materials, removing what is left after the perforating gun was fired is less costly and time consuming. In fact, a degradable firing head would be a best fit for an autonomous perforating gun which cannot be brought back to the surface.

The disclosed embodiments provide a firing head that is based on a dissolvable material and does not require electronics for firing the shaped charges of a perforating gun. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A firing head configured to initiate the firing of an element in a perforating gun, the firing head comprising:

an insert having a bore extending along a longitudinal direction X;

a percussion detonator facing the bore and including an explosive material that is configured to detonate;

a firing pin located partially in the bore; and a retention mechanism located on the firing pin and preventing the firing pin to move along the longitudinal direction X into the bore, wherein the retention mechanism includes a degradable material that is configured to chemically react with a well fluid so that the retention mechanism degrades until freeing the firing pin so that the firing pin moves along the longitudinal direction X into the bore and strikes the percussion detonator.

2. The firing head of claim 1, wherein the retention mechanism frees the firing pin after a predetermined amount of time.

3. The firing head of claim 2, wherein the amount of time is between 10 minutes and 6 hours.

4. The firing head of claim 1, wherein the firing pin has a head portion, a body portion and a neck portion, which connects the head portion to the body portion, and wherein the body portion is provided within the bore while the head portion is provided outside the bore.

5. The firing head of claim 4, wherein the retention mechanism is formed only around the neck portion of the firing pin.

6. The firing head of claim 1, wherein the retention mechanism includes a blocking material and the degradable material.

7. The firing head of claim 6, wherein the blocking material blocks the degradable material from being directly exposed to the well fluid.

8. The firing head of claim 1, further comprising:

a housing that holds the insert and an additional insert, and the additional insert is configured to hold the percussion detonator, wherein the housing is configured to attach with threads to the perforating gun.

9. The firing head of claim 1, wherein the firing pin is actuated exclusively due to a pressure difference at opposite ends of the firing pin.

* * * * *